US006810927B2

(12) United States Patent
Ronchi

(10) Patent No.: US 6,810,927 B2
(45) Date of Patent: Nov. 2, 2004

(54) DEVICE FOR IN-LINE SUPPLYING OF ADDITIVES TO A BASE PRODUCT, IN PARTICULAR FOR FILLING MACHINES, AND ASSOCIATED FILLING MACHINE

(75) Inventor: Cesare Ronchi, Cassina De'Pecchi (IT)

(73) Assignee: Ronchi Mario S.p.A., Gessate (IT)

( * ) Notice: Subject to any disclaimer, the term of this patent is extended or adjusted under 35 U.S.C. 154(b) by 0 days.

(21) Appl. No.: 10/434,046

(22) Filed: May 8, 2003

(65) Prior Publication Data

US 2003/0213528 A1 Nov. 20, 2003

(30) Foreign Application Priority Data

May 14, 2002 (IT) ..... MI2002A1030

(51) Int. Cl.[7] ..... B65B 43/42; B67C 3/00

(52) U.S. Cl. ..... 141/146; 141/144; 141/145; 141/237; 141/238

(58) Field of Search ..... 141/2, 18, 67, 141/94, 95, 104, 105, 129, 192, 234–238, 242–244, 144–146

(56) References Cited

U.S. PATENT DOCUMENTS

| | | | | |
|---|---|---|---|---|
| 1,487,414 A | | 3/1924 | Weatherhead | |
| 2,372,899 A | | 4/1945 | Kantor | |
| 5,133,391 A | * | 7/1992 | Johansson et al. | 141/1 |
| 5,450,882 A | * | 9/1995 | Cragun | 141/9 |
| 5,551,491 A | * | 9/1996 | Baruffato et al. | 141/145 |
| 5,944,074 A | * | 8/1999 | Leahy et al. | 141/192 |

FOREIGN PATENT DOCUMENTS

| | | |
|---|---|---|
| DE | 339070 | 7/1921 |
| EP | 0775668 | 5/1997 |

* cited by examiner

*Primary Examiner*—Timothy L. Maust
(74) *Attorney, Agent, or Firm*—Timothy J. Keefer; Seyfarth Shaw LLP

(57) ABSTRACT

Device for supplying additives (A, B, C) and machine for filling containers (4) with a fluid product (6) supplied to delivery heads (5) by means of a header (7; 7; 107) and distribution ducts (7*a*; 7*b*) comprising means (10*a*, 10*b*, 10*c*, 11; 110A, 110B, 110C, 11) for supplying said additives (A, B, C) to the said header (7; 7; 107) receiving the base product (6).

11 Claims, 1 Drawing Sheet

Figure 1:
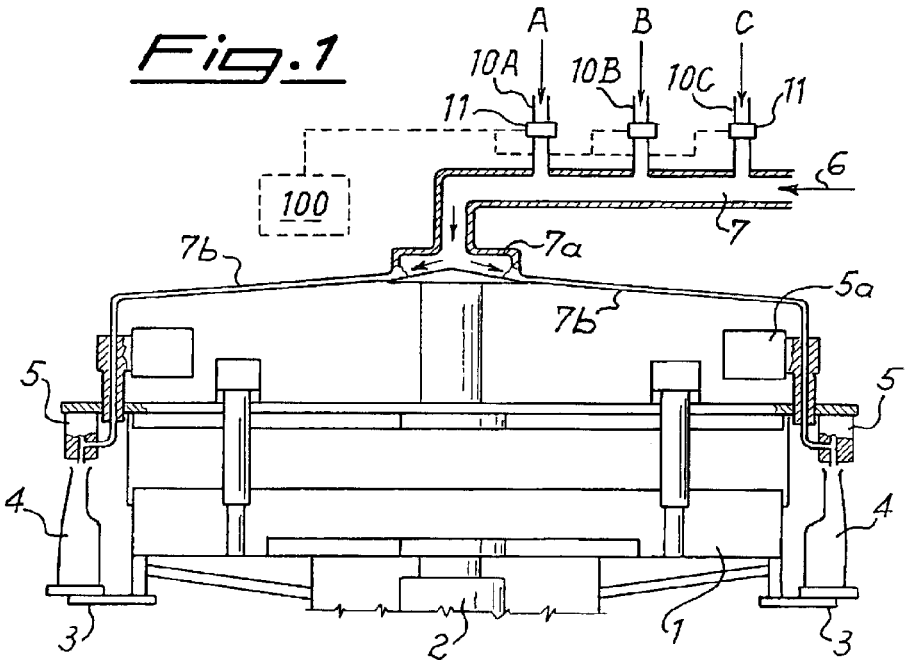

A
B
C
10A
10B
10C
11
11
6
100
7
7b
7a
7b
5a
5
5
4
4
3
2
1
3

110A
10A
11
A
110B
B
10B
110C
C
10C
11
107
6
7
7a
7b
5a
5a
200
117b
117a
117b
5
5
4
4
1
2
3

DEVICE FOR IN-LINE SUPPLYING OF ADDITIVES TO A BASE PRODUCT, IN PARTICULAR FOR FILLING MACHINES, AND ASSOCIATED FILLING MACHINE

CROSS REFERENCE TO RELATED APPLICATION

This application claims the priority of Italian patent application serial No. MI2002A 001030, filed on May 14, 2002.

The present invention relates to a device for supplying additives to machines for filling containers with a fluid product and an associated filling machine.

In the technical sector relating to the packaging of liquid and/or fluid products, so-called filling machines are known, said machines being able to introduce automatically a programmed quantity of product into individual containers which are subsequently sealed and conveyed away for boxing.

It is also known that these machines are formed by a circular platform onto which the empty containers are fed and arranged at regular angular intervals so that, by imparting a rotational movement to the platform, said containers are arranged in a coaxial position underneath fixed heads for delivering the quantity of product envisaged for filling the container.

It is also known that these delivery heads are connected to supply ducts radially connected to a central header into which the product to be packaged flows.

As a result of this configuration, it is required to prepare different types of finished product before they are supplied to the machine, resulting in considerable storage problems and a reduced flexibility of the machine, which is also subject to a notable downtime due to the need to change over the product storage vessels and the need to perform complicated machine flushing-out operations when the products are changed.

Since said products are normally obtained from a base formulation to which suitable additives specifically intended for the particular function of the finished product are added, the problem arises of providing container filling machines in which it is possible to supply a base product with the selective addition of different additives during the continuous operation of the machine.

Within the scope of this problem it is also required that said additives should be able to be added in a selective manner also in relation to different product delivery heads so that, during the same operating cycle, the containers may be filled with different finished products.

In addition, it is required that the devices able to provide a solution to the abovementioned technical problems should be simple and inexpensive to produce and able to be applied easily to machines of the known type without the need for complicated accessories.

This technical problem is solved according to the present invention by a device for supplying additives to machines for filling containers with a fluid product supplied to delivery heads by means of a header and distribution ducts, which comprises means for supplying said additives to the said header receiving the base product.

Figure 2:
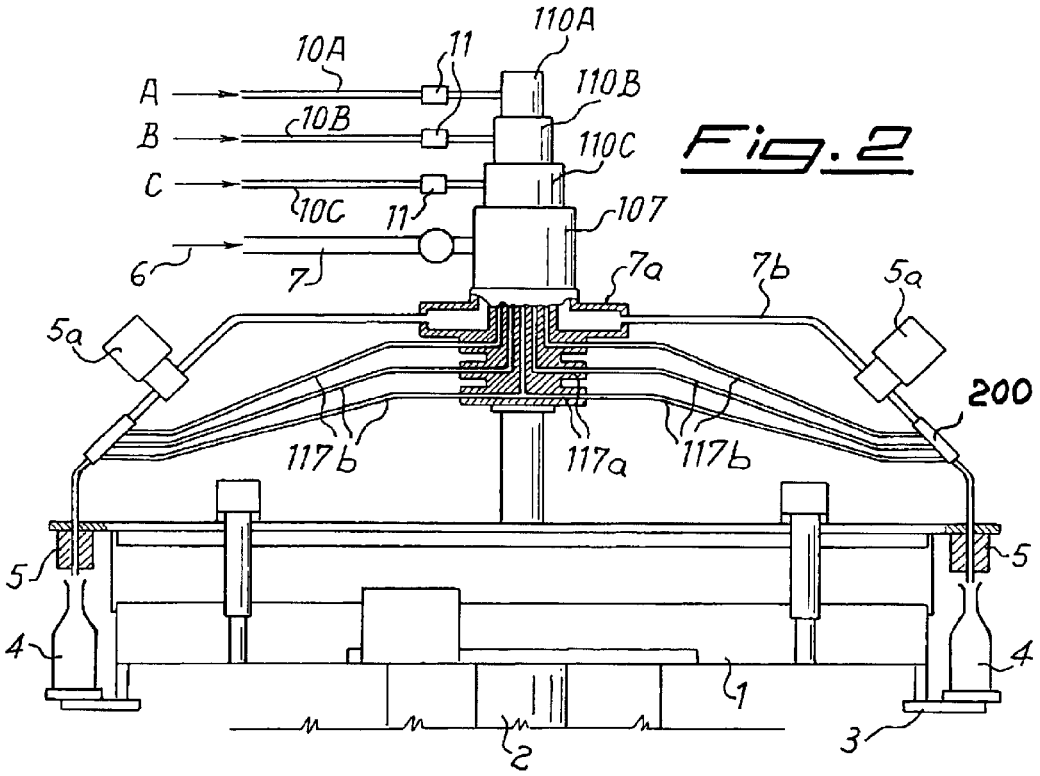

Further details and characteristic features will emerge clearly from the following description of a non-limiting example of embodiment of the device according to the invention provided with reference to the accompanying figures, in which:

FIG. 1 shows a schematic cross-section, along a vertical plane, through a filling machine with a device for supplying additives according to the present invention; and FIG. 2 shows a cross-section, similar to that of FIG. 1, of a second example of embodiment of the delivery device according to the present invention.

As illustrated in FIG. 1, a filling machine according to the invention comprises a rotating table 1 actuated by means of coaxial means 2 and having, along its circumference edge, supports 3 for containers 4 arranged coaxially underneath heads 5 for delivering a fluid 6 supplied by means of a header 7, one end of which enters coaxially into a distributor 7*a* to which ducts 7*b* for supplying the product to the heads 5 are radially connected.

Said ducts 7*b* have, inserted along them, a respective metering device 5*a*.

According to the invention it is envisaged that one or more ducts 10A, 10B, 10C for supplying different additives A,B,C are connected along a section of the header 7, which ducts have, inserted along them, a respective valve 11 for opening/closing their apertures.

Said valves 11 may be conveniently of the electromagnetic type which can be remotely operated by means of centralized control and actuating devices which are schematically indicated by 100 in the figures.

With the device for supplying additives according to the present invention it is therefore possible to supply a single base product 6 and a plurality of additives A,B,C independently of each other by means of the selective actuation of said valves 11, so as to determine the final specialization of the product during the filling cycle and upstream of the delivery phase.

The configuration according to FIG. 1 therefore solves the problem posed in a static manner, but with the limitation consisting in the fact that it is not possible to supply selectively different additives A,B,C to different delivery heads 5.

This problem is solved, however, by the second embodiment of the device according to the invention shown in FIG. 2 where, as in the case of FIG. 1, the base product 6 is supplied to the header 7, one end of which enters coaxially into a distributor 7*a* to which ducts 7*b* for supplying the product to the heads 5 are radially connected.

The configuration shown in FIG. 2 envisages a section 107 coaxial with the duct 7 for distributing the base fluid and a plurality of tubular elements 110A, 110B, 110C, respectively, arranged coaxially with the said vertical section 107 of the duct 7 for distributing the base fluid and connected to a respective pipe 10A, 10B, 10C for supplying a respective additive A,B,C.

On the opposite side to the supplying side, each of said coaxial tubular elements 110A, 110B, 110C terminates in a respective header 117*a* to which the first end of a plurality of distribution ducts 117*b* is connected, the other end thereof being connected to a section of the duct 7*b* for supplying the base product, arranged upstream of each delivery head 5.

It is thus possible to supply selectively to each head one or other of the additives A,B,C—or combinations thereof—providing, if required, the possibility of differentiating each delivery head 5—or groups of heads—from one another so that each container 4—or groups of containers 4—may be filled with different products.

It is therefore clear how with the device and the filling machine according to the invention it is possible to store large volumes of a single base product 6 and small volumes of the different additives which, since they are added in a small percentage compared to the total weight of the finished product, require a very small storage capacity.

In addition to reducing the problems associated with storage of the base product, the devices and the machine according to the invention are also able to reduce substantially the downtime of the machine resulting from the need to wash it when there is a variation in the additives, it being in fact possible to maintain a large number of different additives always available for supplying to the machine and, in the event of variation of one of them, to wash solely the line supplying that specific additive which is replaced by another one.

What is claimed is:

1. A rotating machine for filling containers with a fluid product supplied to a plurality of delivery heads by means of a single header and comprising a device connected to said header for selectively supplying one or more of a plurality of additives to said fluid product, in which said device for supplying additives comprises a plurality of additive ducts along which controllable valves are arranged to open and close said ducts;

said header comprising a single header, and connected to a distribution element;

said distribution element being in turn connected to a first end of a plurality of outwardly extending ducts, the opposite end of each of said outwardly extending ducts being respectively connected each to a single delivery head; and a measuring device provided for each delivery head downstream of the distribution element and upstream from the delivery head itself along the respective outwardly extending duct.

2. The machine according to claim 1, wherein said at least one controllable valve is connected to a programmable actuating means.

3. The machine according to claim 1, wherein said single header comprises a section coaxial with an axis of rotation of the machine.

4. The machine according to claim 3, wherein said additive ducts comprise respective sections coaxial with the axis of rotation of the machine.

5. The machine according to claim 4, wherein said respective coaxial sections of the additive ducts are situated concentrically inside the coaxial section of the header supplying the fluid product.

6. The machine according to claim 4, wherein opposite ends of said coaxial sections of the additive ducts supplying the additives are respectively connected to an associated duct for supplying the additives to at least one distribution element.

7. The machine according to claim 6, wherein a first end of each of a plurality of pipes is connected to said distribution element, the other end thereof being connected to said delivery head through mixing means.

8. The machine according to claim 1, wherein said additive ducts comprise respective sections coaxial with the axis of rotation of the machine.

9. The machine according to claim 1, wherein said respective coaxial sections of the additive ducts are situated concentrically inside the coaxial section of the header supplying the fluid product.

10. The machine according to claim 1, wherein opposite ends of said coaxial sections of the additive ducts supplying the additives are respectively connected to an associated duct for supplying the additives to at least one distribution element.

11. The machine according to claim 6, wherein a first end of each of a plurality of pipes is connected to said distribution element, the other end thereof being connected to said delivery head through mixing means.

* * * * *